United States Patent [19]

Malkin et al.

[11] 4,240,249

[45] Dec. 23, 1980

[54] INSTANTANEOUS CALENDAR DEVICE FOR TIMEPIECES

[76] Inventors: Daniel D. Malkin, ulitsa Junykh Lenintsev, 95/13, korpus 1, kv. 31; Gennady A. Kruglov, Baltiiskaya ulitsa, 4, kv. 21; Boris A. Peredkov, ulitsa Moldagulovoi, 16, korpus 2, kv. 19; Evgeny V. Kulikov, Maly Koptevsky proezd, 6, kv. 51, all of Moscow, U.S.S.R.

[21] Appl. No.: 17,688

[22] Filed: Mar. 5, 1979

[51] Int. Cl.[2] ..... G04B 19/24; G04B 19/02

[52] U.S. Cl. ..... 368/28; 368/37; 368/77; 368/221

[58] Field of Search ..... 58/4 R, 4 A, 5, 58, 58/125 B

[56] References Cited

U.S. PATENT DOCUMENTS

| | | | |
|---|---|---|---|
| 3,186,159 | 6/1965 | Schneiter | 58/58 |
| 3,969,888 | 7/1976 | Veuilleumier et al. | 58/58 |

*Primary Examiner*—Edith S. Jackmon

*Attorney, Agent, or Firm*—Lackenbach, Lilling & Siegel

[57] ABSTRACT

A day disk cooperates with a storage of mechanical energy via a seven-position Maltese mechanism. A Maltese cross of said mechanism is rigidly coupled to and coaxial with the day disk. A transfer pin of the Maltese cross is set on an intermediate gear of the storage. A driven disk includes a projection for the transfer of a toothed date ring. The locking surfaces of the Maltese cross lock on the driven disk. Provision is made of a free unloaded lever with one arm locking in position the date ring and the other arm of said lever resting against the projections of the Maltese cross, thereby relieving the moment of load of the calendar device on the gear train and improving the reliability of the timepiece.

8 Claims, 3 Drawing Figures

INSTANTANEOUS CALENDAR DEVICE FOR TIMEPIECES

FIELD OF THE INVENTION

The present invention relates to mechanical calendar devices and can be used primarily in timepieces.

DESCRIPTION OF THE PRIOR ART

There are known in the art instantaneous calendar devices including a storage fashioned as two coaxial wheels of different diameter with a spring forced between said wheels, a pin for transferring a date ring being mounted on one of the wheels (cf., Swiss Pat. Nos. 535,447 and 545,500, Int.Cl. G O4 B 19/24).

There are also known instantaneous calendar devices including a storage fashioned as a wheel and a cam coaxially mounted with a spring forced therebetween, said storage cooperating via an intermediate star wheel link with a day disk, a date ring being transferrable by a floating lever at the moment of cooperation with a projection of the storage cam. Locks serve to arrest said date ring and are star wheel and fashioned as spring-biased cams (cf., Swiss Pat. No. 524,847 of 1972).

This prior art instantaneous calendar device features a considerable consumption of energy due to the high moment on the hour wheel shaft, spent upon winding the storage spring.

In said prior art device, the lock is in permanent (except for the switching time) contact with a cylindrical rotating surface on the 24-hour wheel. The emerging forces of friction increase the moment of load from the calendar on the mechanism and, when correcting the date ring, a resilient arm is forced away and sharply increases the load on the arm coming in contact with the surface on the 24-hour wheel.

Moreover, when correcting the dates (which is done manually), the forcing away of one of the lock arms results in an increased load by the other arm directly upon the rotating disk of the storage, thereby resulting in a sharp increase of the moment in the gear train. This feature eliminates the possibility of using such devices in electronic timepieces with step-by-step motors and adversely affects the precision of mechanical timepieces.

SUMMARY OF THE INVENTION

It is an object of the present invention to develop a calendar device characterized by a reduced consumption of energy required for the functioning of the device.

It is another object of this invention to develop an instantaneous calendar device serving to improve the reliability of operation of the timepiece as a whole.

It is till another object of the present invention to develop an instantaneous calendar device which, while involving no use of costly and sophisticated mechanisms, would prolong the service life and improve the precision of timepieces.

In order to accomplish these and other objects of the present invention, disclosure is made of an instantaneous calendar device for timepieces comprising a date ring with a toothed rim, locked in position by a lever member, and a day disk cooperating via an intermediate member with a storage of mechanical energy having a driven disk with a projection designed for transferring said date ring. The herein disclosed device is characterized in that said driven disk of the storage is coupled with said day disk via a seven-position Maltese mechanism, whose Maltese cross serves as said intermediate member while the locking arcs of said cross close up alternately on the side surface of an intermediate gear carrying a pin for transferring the Maltese cross.

This technical solution helps to considerably reduce the consumption of energy required for the operation of the calendar mechanism by providing a kinematic, rather than power, closing of the date ring of the calendar mechanism. In so doing, the toothed member stays immobile while the spring of the energy storage is being wound.

In accordance with one embodiment of the present invention, disclosure is made of an instantaneous calendar device for timepieces, characterized in that said Maltese cross is rigidly coupled with the day disk for coaxial rotation therewith, the curvature of the locking surfaces of the Maltese cross being greater than the curvature of the side surface of the driven disk of the storage.

This technical improvement offers optimum coupling of the Maltese cross with the day disk and the most favorable curvilinear shape and size of the locking portions of the Maltese cross.

In accordance with another embodiment of the present invention, disclosure is made of an instantaneous calendar device for timepieces, characterized in that cooperating with projections of said Maltese cross, formed at the junctions of the locking surfaces thereof, is a free lever of said locking member of the date ring, said member having such a shape that at the moment said lever arm is held at a projection of the Maltese cross a thrust of the locking member is held between the teeth of the date ring, the length of said thrust arm being less than the distance from the center of rotation of the free lever to the recess in the locking surface of the Maltese cross.

This technical solution, in particular, guarantees a free (independent of the springs) setting of the lever lock and provides, owing to precision geometry, for appropriate closing of the lever with the locking surfaces of the Maltese cross and with the teeth of the date ring.

DESCRIPTION OF THE DRAWING

This invention will be better understood upon considering the following detailed description of an examplary embodiment thereof, with due reference to the accompaying drawings in which.

DETAILED DESCRIPTION OF THE INVENTION

Figure 1:
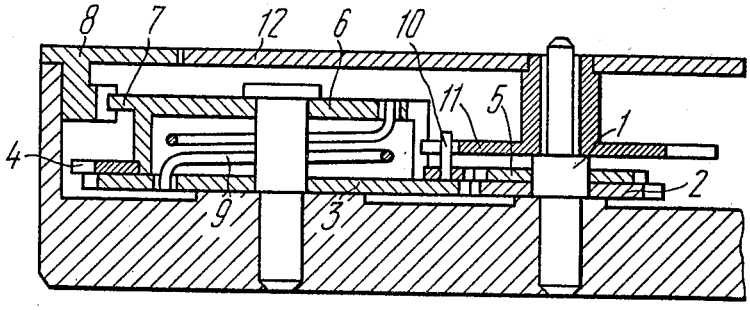
FIG. 1 is an elevational sectional view of the herein disclosed calendar device.
Figure 2:
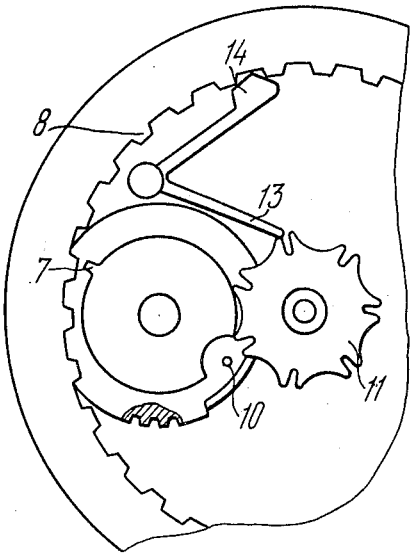
FIG. 2 is a top, plan view of the device according to the invention at the moment of locking the date ring.
Figure 3:
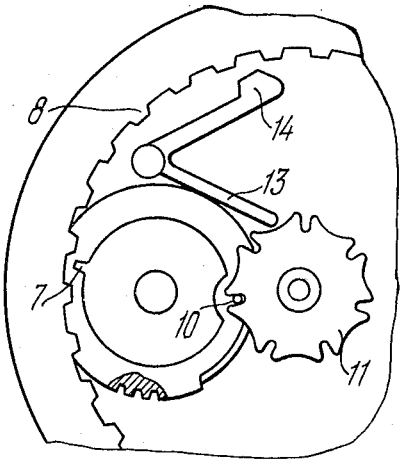
FIG. 3 is a view similar to that shown in FIG. 2, with the lever unlocked.

Referring now to FIG. 1 of the accompanying drawings, set on a shaft 1 is an hour wheel 2 in mesh with a 24-hour wheel 3 of a storage. Mounted coaxially with the 24-hour wheel 3 is an intermediate gear 4 of the storage, said latter gear having in a sector of about 75° a recess through the depth of toothing. The gear 4 is in mesh with a wheel 5 mounted coaxially with the hour wheel 2. Pressed in the intermediate gear 4 is a driven disk 6 of the storage having a projection 7 cooperating once a day with the date ring 8 (FIGS. 2, 3). A spring 9 is forced in the storage between the driven disk 6 and the 24-hour wheel 3.

The gear ratio of the hour wheel 2 and the 24-hour wheel 3 relative to the wheel 5 and gear 4, respectively, is selected such that the mismatch upon rotation of these pairs is about 60° a day.

Rigidly secured on the intermediate gear 4 in the recessed sector is a pin 10 adapted to cooperate once a day with one of the grooves of a toothed member fashioned as a seven-position Maltese cross 11 loose-fitted on the shaft 1; a day disk 12 is rolled in the bushing of the Maltese cross.

The lock of the date ring 8 is made as a double-arm lever with a lever arm 13 contacting projections of the next locking arc of the Maltese cross 11 and the, thrust arm 14 having a wedgeshaped end receivable between the teeth of the date ring 8.

The Maltese cross 11 is rigidly coupled with the day disk 12 for coaxial rotation therewith, the curvature of the locking surfaces of the Maltese cross 11 being greater than the curvature of the side surface of the driven disk 6 of the storage.

Cooperating with projections of the Maltese cross 11, formed at the junctions of the locking surfaces thereof, is the lever arm 13 of said lock of the date ring, said lock member having such a shape that at the moment the lever arm 13 is held at a projection of the Maltese cross the thrust arm 14 is held between the teeth of the date ring 8, the length of the thrust arm 14 being less than the distance from the center of rotation of the lever arm 13 to the recess in the locking surface of the Maltese cross 11.

The calendar device according to the invention operates in the following manner.

Upon rotation of the clock shaft 1, the wheels 3 and 4 of the storage turn in one direction, the wheel 3 overtaking the intermediate gear 4 to wind the spring 9 which stores the energy. While so doing, to the crest of one of the projections of the Maltese cross 11 there is interference pressed the lever arm 13 of the lock, the wedge-shaped end of whose thrust arm 14 locks the date ring 8.

The moment of intermediate gear 4 of the storage turns to face with its recess the mated wheel 5, it comes out of engagement and turns sharply under the effect of the spring 9. In so doing, the pin 10 enters the groove of the Maltese cross 11 and turns it through 1/7th of a turn.

Upon turning, the Maltese cross 11, similar to the cam, releases the lock; the projection 7 of the driven disk 6 cooperates with the date ring 8 to transfer it through one step. The Maltese cross 11 completes the turn, and the wedge-shaped end of the thrust arm 14 of the lock is again received in the recess in the date ring. Then, the cycle is repeated.

The herein disclosed calendar device is characterized by the kinematic (rather than power) locking of the calendar date ring 8.

The locking of the date ring 8 by the lock having resilient arms serves to preclude the diverse effect of the calendar on the gear train when changing dates by hand. Inasmuch as the toothed member (irrespective of possible embodiments thereof) stays immobile in the course of winding the storage spring, energy losses are reduced considerably.

What is claimed is:

1. An instantaneous calendar device for timepieces, comprising: a date ring with a toothed rim; a day disk; a storage of mechanical energy coupled with a gear train and having a driven disk with a projection for transferring said date ring; a seven-position Maltese mechanism interconnecting said storage and said day disk and including a Maltese cross rigidly coupled to, and in coaxial relationship with, said day disk, locking surfaces of the Maltese cross closing on the side surface of said driven disk; a pin for transferring the Maltese cross set on the periphery of an intermediate gear of the storage; and a lever lock of the date ring cooperating with the toothed rim of the date ring.

2. An instantaneous calendar device for timepices as set forth in claim 1, wherein said Maltese cross is rigidly coupled with the day disk for coaxial rotation therewith, the curvature of the locking surfaces of the Maltese cross being greater than the curvature of the side surface of the driven disk of the storage.

3. An instantaneous calendar device for timepieces, as set forth in claim 1, wherein with projections of said Maltese cross, formed at the junctions of the locking surfaces thereof, there cooperates a lever arm of said locking member of the date ring, said locking member having such a shape that at the moment said lever arm is held at a projection of said Maltese cross a thrust arm of said locking member is held between the teeth of the date ring, the length of said thrust arm being less than the distance from the center of rotation of the lever to a recess in the locking surface of the Maltese cross.

4. An instantaneous calendar device for time pieces having a hour wheel and a 24-hour wheel in mesh with each other and an intermediate gear mounted coaxially with said 24-hour wheel, comprising a date ring with a toothed rim; a day disk; a driven disk mounted on the intermediate gear and having a projection interacting with teeth of said date ring to rotate said date ring; a seven-position Maltese means rigidly coupled to, and coaxially mounted with, said day disk, locking surfaces of the Maltese means interacting with a side surface of said driven disk; a pin for transferring said Maltese means mounted on the periphery of said intermediate gear; and a locking means having a thrust arm interacting with teeth of said date ring and a lever arm interacting with said locking arcs of said Maltese means.

5. An instantaneous calendar device according to claim 4, wherein said Maltese means is mounted for coaxial rotation with said day disk.

6. An instantaneous calendar device according to claim 4, wherein the curvature of the locking surfaces of the Maltese means is greater than the curvature of the side surface of said driven disk.

7. An instantaneous calendar device according to claim 4, wherein projections at the junctions of the locking arcs of the Maltese means cooperate with said lever arm of said locking means; and said locking means has a shape such that at the moment said lever arm contacts one of said projections said thrust arm is held between adjacent teeth of said date ring.

8. An instantaneous calendar device according to claim 7, wherein the length of said thrust arm is less than the distance from the center of rotation of said lever arm to a recess in the locking surfaces of the Maltese means.

* * * * *